US012168586B2

(12) United States Patent
Uchibori et al.

(10) Patent No.: US 12,168,586 B2
(45) Date of Patent: Dec. 17, 2024

(54) SHEET TRANSPORT DEVICE AND METHOD OF CONTROLLING SHEET TRANSPORT DEVICE PRELIMINARY CLASS

(71) Applicant: SEIKO EPSON CORPORATION, Tokyo (JP)

(72) Inventors: Kenji Uchibori, Shiojiri (JP); Masaki Miyazawa, Matsumoto (JP); Hirohisa Adachi, Matsukawa-machi (JP); Shun Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 142 days.

(21) Appl. No.: 18/162,582

(22) Filed: Jan. 31, 2023

(65) Prior Publication Data

US 2023/0242367 A1 Aug. 3, 2023

(30) Foreign Application Priority Data

Feb. 1, 2022 (JP) ..... 2022-014031

(51) Int. Cl.
*B65H 31/02* (2006.01)
*B65H 29/38* (2006.01)
(Continued)

(52) U.S. Cl.
CPC ..... *B65H 31/02* (2013.01); *B65H 29/38* (2013.01); *B65H 31/20* (2013.01); *B65H 31/36* (2013.01);
(Continued)

(58) Field of Classification Search
CPC ..... B65H 31/02; B65H 31/20; B65H 31/34; B65H 31/36; B65H 43/00; B65H 43/02; B65H 43/06; B65H 43/08; B65H 2301/541; B65H 2403/512; B65H 2404/1114; B65H 2404/65; B65H 2404/651; B65H 2404/652; B65H 2404/653; B65H 2405/1116; B65H 2405/11161; B65H 2405/11162;
(Continued)

(56) References Cited

U.S. PATENT DOCUMENTS

2009/0014947 A1* 1/2009 Taki ..... B65H 31/10 271/264
2010/0194024 A1* 8/2010 Yahata ..... B65H 31/36 271/220
(Continued)

FOREIGN PATENT DOCUMENTS

JP 2003-182923 7/2003
JP 2018-154413 A 10/2018
JP 2020-152525 9/2020

*Primary Examiner* — Prasad V Gokhale
(74) *Attorney, Agent, or Firm* — WORKMAN NYDEGGER

(57) ABSTRACT

A sheet transport device includes a loading unit at which a sheet to be conveyed is loaded, a transport unit configured to impart to the sheet loaded at a sheet loading surface of the loading unit a transport force for transporting the sheet toward an alignment unit, and an adjustment unit configured to adjust the transport force. The adjustment unit includes a movable loading unit formed so that at least part of the sheet loading surface is configured to protrude toward the transport unit and a driving unit configured to displace the movable loading unit in a protruding direction and a retracting direction.

14 Claims, 8 Drawing Sheets

(51) Int. Cl.
*B65H 31/20* (2006.01)
*B65H 31/36* (2006.01)
*B65H 43/00* (2006.01)

(52) U.S. Cl.
CPC ..... *B65H 43/00* (2013.01); *B65H 2301/541* (2013.01); *B65H 2403/512* (2013.01); *B65H 2404/1114* (2013.01); *B65H 2405/11161* (2013.01); *B65H 2405/11162* (2013.01); *B65H 2511/10* (2013.01); *B65H 2511/30* (2013.01); *B65H 2515/10* (2013.01); *B65H 2515/12* (2013.01)

(58) Field of Classification Search
CPC ..... B65H 2405/1117; B65H 2511/10; B65H 2511/15; B65H 2511/30; B65H 2515/10; B65H 2515/12; B65H 2515/40; B65H 2515/805
See application file for complete search history.

(56) References Cited

U.S. PATENT DOCUMENTS

2012/0313309 A1* 12/2012 Yoshida ..... B65H 31/02 270/58.11
2015/0291375 A1* 10/2015 Tsuji ..... B65H 31/24 271/9.04
2018/0265323 A1* 9/2018 Kim ..... B65H 43/00

* cited by examiner

| NUMBER OF SHEETS | DISTANCE FROM SHEET LOADING SURFACE TO UPPER SURFACE OF MOVABLE LOADING UNIT [mm] | | |
|---|---|---|---|
| | SETTING A | SETTING B | SETTING C |
| FIFTH SHEET | 0.0 | 2.0 | 4.0 |
| TENTH SHEET | 0.0 | 2.0 | 4.0 |
| FIFTEENTH SHEET | 0.0 | 1.5 | 3.5 |
| TWENTIETH SHEET | 0.0 | 1.5 | 3.5 |
| TWENTY -FIFTH SHEET | 0.0 | 1.0 | 3.0 |
| THIRTIETH SHEET | 0.0 | 1.0 | 3.0 |
| THIRTY-FIFTH SHEET | 0.0 | 0.5 | 2.5 |
| FORTIETH SHEET | 0.0 | 0.5 | 2.5 |
| FORTY-FIFTH SHEET | 0.0 | 0.0 | 2.0 |
| FIFTIETH SHEET | 0.0 | 0.0 | 2.0 |

FIG. 7

SHEET TRANSPORT DEVICE AND METHOD OF CONTROLLING SHEET TRANSPORT DEVICE PRELIMINARY CLASS

The present application is based on, and claims priority from JP Application Serial Number 2022-014031, filed Feb. 1, 2022, the disclosure of which is hereby incorporated by reference herein in its entirety.

BACKGROUND

1. Technical Field

The present disclosure relates to a sheet transport device and a method of controlling the sheet transport device.

2. Related Art

An example of this type of sheet transport device is disclosed in JP-A-2018-154413. JP-A-2018-154413 discloses a sheet transport device including a paddle as a unit that imparts to a sheet discharged onto a sheet loading surface of a loading unit in a post-processing device a transport force for transporting the sheet in a predetermined direction. The sheet transport device transports the sheet to a predetermined position by rotating the paddle.

When the paddle is fixed, a distance between the uppermost sheet and the paddle gradually decreases as the number of sheets loaded at the loading unit increases. Consequently, the transport force of the paddle changes between a state in which the number of loaded sheets is small and a state in which the number of loaded sheets is great. Consequently, a sheet transportation failure may occur. JP-A-2018-154413 does not contain any description that considers this point.

SUMMARY

In order to solve the problem described above, a sheet transport device according to the present disclosure includes a loading unit at which a sheet to be conveyed is loaded, a transport unit configured to impart to the sheet loaded at a sheet loading surface of the loading unit a transport force for transporting the sheet toward an alignment unit, and an adjustment unit configured to adjust the transport force, wherein the adjustment unit includes a movable loading unit formed so that at least part of the sheet loading surface is configured to protrude toward the transport unit and a driving unit configured to displace the movable loading unit in a protruding direction and a retracting direction.

In addition, a method of controlling a sheet transport device according to the present disclosure is a method of controlling a sheet transport device, the sheet transport device including a loading unit at which a sheet to be conveyed is loaded, a transport unit configured to impart to the sheet loaded at a sheet loading surface of the loading unit a transport force for transporting the sheet toward an alignment unit, an adjustment unit configured to adjust the transport force, a control unit configured to control the adjustment unit, and one or both of a loading number counting unit configured to count the number of the sheet loaded at the loading unit and a counting unit configured to count the cumulative number of the sheet transported by the transport unit, the adjustment unit including a movable loading unit formed so that at least part of the sheet loading surface is configured to protrude toward the transport unit and a driving unit configured to displace the movable loading unit in a protruding direction and a retracting direction, the method including adjusting an amount of displacement of the movable loading unit based on one or both of the number of the loaded sheet and the cumulative number of the sheet.

BRIEF DESCRIPTION OF THE DRAWINGS

FIG. 7 is an example of a table used for controlling the driving unit in a manner corresponding to FIG. 5 and FIG. 6.

DESCRIPTION OF EXEMPLARY EMBODIMENTS

Figure 1:
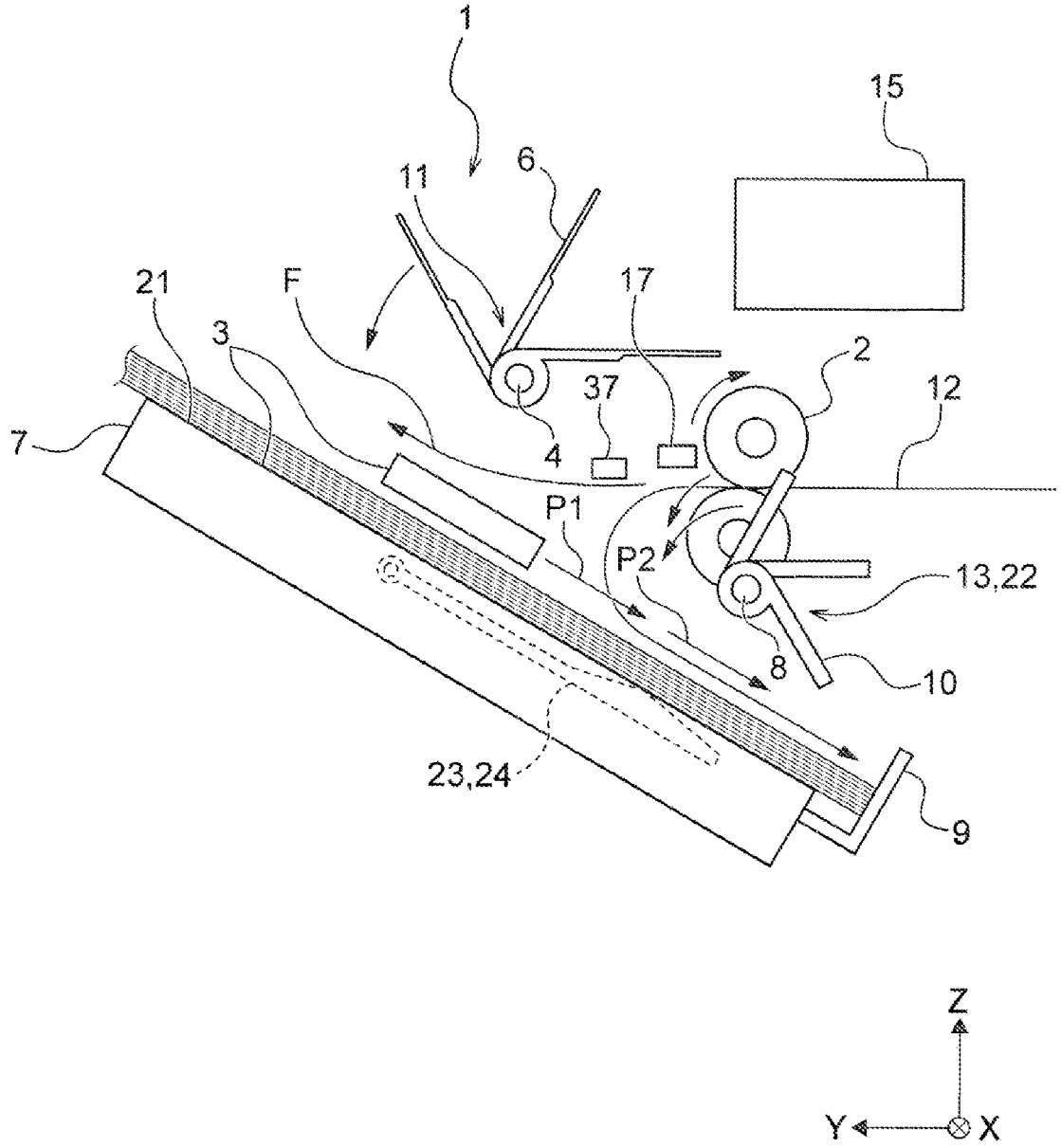
FIG. 1 is a schematic configuration diagram of a main part of a sheet transport device according to Embodiment 1.

Hereinafter, the present disclosure will be schematically described first.

In order to solve the above problems, a sheet transport device according to a first aspect of the present disclosure includes a loading unit at which a sheet to be conveyed is loaded, a transport unit that imparts to the sheet loaded on a sheet loading surface of the loading unit a transport force for transporting the sheet toward an alignment unit, and an adjustment unit that adjusts the transport force, wherein the adjustment unit includes a movable loading unit formed so that at least part of the sheet loading surface is configured to protrude toward the transport unit and a driving unit that displaces the movable loading unit in a protruding direction and a retracting direction.

According to this aspect, the adjustment unit that adjusts the transport force is provided. Furthermore, the adjustment unit includes the movable loading unit formed so that at least part of the sheet loading surface is configured to protrude toward the transport unit, and a driving unit that displaces the movable loading unit. Thus, the adjustment unit adjusts an amount of displacement of the movable loading unit so that the transport force does not decrease, and thus curbs the occurrence of a sheet transportation failure.

According to a sheet transport device of a second aspect of the present disclosure, in the first aspect, the movable loading unit is part of the sheet loading surface in a width direction intersecting a direction of the transport force, and is a part facing the transport unit.

According to this aspect, the movable loading unit is part of the sheet loading surface and is a part facing the transport unit. Thus, the transport force is adjusted at a position at which the transport force acts, and thus it is effective.

According to a sheet transport device of a third aspect of the present disclosure, in the first aspect or the second aspect, the movable loading unit is a swinging portion pivotally supported in the direction intersecting the direction of the transport force and including a free end that swings, and the driving unit includes a cam that displaces the swinging portion.

According to the present aspect, the movable loading unit is a swinging portion of which one end is pivotally supported and a free end swings, and the driving unit that displaces the swinging portion is a cam. Thus, the protrusion or the retraction of the movable loading unit can be performed with a small number of components.

According to a sheet transport device of a fourth aspect of the present disclosure, in any one of the first to third aspects, the driving unit is disposed on the back surface side of the loading unit.

According to this aspect, since the driving unit is disposed on the back surface side of the loading unit, the sheet transport device can be configured without increasing a size of the surface side of the loading unit.

According to a sheet transport device of a fifth aspect of the present disclosure, in the fourth aspect, the loading unit includes a pair of side cursors for aligning both end portions in the width direction of the sheet loaded on the sheet loading surface, a pair of side cursor moving units that moves positions of the pair of side cursors in the width direction is disposed on the back surface side of the loading unit, and the driving unit is disposed between the pair of side cursor moving units.

According to this aspect, the pair of side cursor moving units is disposed on the back surface side of the loading unit, and the driving unit is disposed between the pair of side cursor moving units. Thus, since the driving unit is disposed in an empty space on the back side of the loading unit, the sheet transport device can be configured without increasing a size of the back surface side of the loading unit.

According to a sheet transport device of a sixth aspect of the present disclosure, in any one of the first to fifth aspects, a control unit that controls the adjustment unit, and a loading number counting unit that counts the number of sheets loaded into the loading unit are included, and the control unit performs displacement by the driving unit based on the number of loaded sheets counted by the loading number counting unit.

The transport force to the sheet of the transport unit changes between an initial state of start of sheet transportation and a state in which the number of loaded sheets has increased.

According to this aspect, since the control unit performs the displacement by the driving unit based on the number of loaded sheets counted by the loading number counting unit, it is possible to cope with the change. That is, since the transport force can be reduced in accordance with an increase in the number of loaded sheets, the transport force to the sheet can be substantially constant.

According to a sheet transport device of a seventh aspect of the present disclosure, in any one of the first to sixth aspects, a counting unit that counts the cumulative number of sheets transported by the transport unit is included, and the control unit performs the displacement by the driving unit based on the cumulative number.

Since the transport unit wears out with continued use, the transport force of the transport unit itself gradually decreases. The cumulative number of sheets counted by the counting unit is information corresponding to the degree of wear due to the continued use.

According to this aspect, the control unit performs the displacement by the driving unit based on the cumulative number of sheets, and thus a reduction in the transport force of the transport unit itself due to the wear can be covered by performing the displacement of the movable loading unit, and can be kept substantially constant.

According to a sheet transport device of an eighth aspect of the present disclosure, in the sixth or seventh aspect, the control unit performs the displacement by the driving unit based on one or both of the number of loaded sheets and the cumulative number of sheets and at least one or more additional elements of the following (1) to (4):

(1) A basis weight of the sheet is greater than a predetermined amount (2) A size of the sheet is greater than a predetermined size (3) Humidity is higher than a predetermined value, or temperature is lower than a predetermined value (4) When the sheet is subjected to printing, a print density is higher than a predetermined value.

Here, the "basis weight" is a weight (g) of a 1 m×1 m sheet. The "print density" is an amount of discharge of ink discharged per unit area, and is also referred to as duty.

(1) The sheet is heavy when the basis weight of the sheet is greater than the predetermined amount, and thus it is difficult to transport the sheet. Therefore, the movable loading unit is brought closer to the transport unit to increase the transport force. The "predetermined amount" is set so that an appropriate transport force can be obtained by collecting data in advance regarding the relationship between the basis weight, the amount of displacement of the movable loading unit, and the transport force.

(2) When a size of a sheet is greater than a predetermined size, a contact area between the sheets is large, and thus it is difficult to transport the sheet. Therefore, the movable loading unit is brought closer to the transport unit to increase the transport force. The "predetermined size" is set so that an appropriate transport force can be obtained by collecting data in advance regarding the relationship between the size of the sheet, the amount of displacement of the movable loading unit, and the transport force.

(3) When the humidity is higher than a predetermined value, friction between the sheets increases, and thus it is difficult to transport the sheet. Therefore, the movable loading unit is brought closer to the transport unit to increase the transport force. The "predetermined value" is set so that an appropriate transport force can be obtained by collecting data in advance regarding the relationship between the humidity, the amount of displacement of the movable loading unit, and the transport force.

Further, since a material of the transport unit is typically rubber, when the temperature is lower than a predetermined value, the material hardens, the transport force is reduced, and thus it is difficult to transport the sheet. Therefore, the movable loading unit is brought closer to the transport unit to increase the transport force. The "predetermined value" is set so that an appropriate transport force can be obtained by collecting data in advance regarding the relationship between the temperature, the amount of displacement of the movable loading unit, and the transport force.

(4) In a case in which the sheets are subjected to printing, when the print density is higher than a predetermined value, the friction between the sheets is large, and thus it is difficult to transport the sheet. Therefore, the movable loading unit is brought closer to the transport unit to increase the transport force. The "predetermined value" is set so that an appropriate transport force can be obtained by collecting data in advance regarding the relationship between the print density, the amount of displacement of the movable loading unit, and the transport force.

According to this aspect, when at least one of the above (1) to (4) is applicable, it is possible to increase the transport force by bringing the movable loading unit closer to the transport unit. Thus, it is possible to curb the occurrence of sheet transportation defects.

According to a sheet transport device of a ninth aspect of the present disclosure, in any one of the first to eighth aspects, the sheets loaded into the loading unit and aligned by the alignment unit can be in any of a stacked state, a shift loading state, and a pre-stapling layered state, and the control unit does not cause the adjustment unit to operate when the sheets are in the stacked state or the shift loading state, and causes the adjustment unit to operate when stapling processing is performed.

Here, the "stacked state" means a state in which the sheet is sequentially loaded on the sheet loading surface.

In addition, the "shift loading state" means a state in which a bundle of a predetermined number of sheets loaded on the sheet loading surface is shifted in the width direction so that each bundle is located shifted.

In addition, the "pre-stapling layered state" means a bundle state, before proceeding to the stapling process, of a bundle of a predetermined number of sheets loaded on the sheet loading surface, and is a process in which an alignment standard of the sheets in the alignment unit is stricter than in the stacked state or the shift loading state.

The alignment standard is not strict for the stacked state and the shift loading state. On the other hand, the alignment standard is strict for the pre-stapling layered state.

According to this aspect, in the case of the stacked state or the shift loading state in which the requirement of alignment quality is low, that is, the alignment standard is not strict, it is possible to reduce the wear of the transport unit by giving priority to curbing wear over securing the transport force.

A method of controlling a sheet transport device according to a tenth aspect of the present disclosure is a method of controlling a sheet transport device, the sheet transport device including a loading unit at which a sheet to be conveyed is loaded, a transport unit that imparts to the sheet loaded on a sheet loading surface of the loading unit a transport force for transporting the sheet toward an alignment unit, an adjustment unit that adjusts the transport force, a control unit that controls the adjustment unit, and one or both of a loading number counting unit that counts the number of sheets loaded into the loading unit and a counting unit that counts the cumulative number of sheets transported by the transport unit, the adjustment unit including a movable loading unit formed so that at least part of the sheet loading surface is configured to protrude toward the transport unit and a driving unit that displaces the movable loading unit in a protruding direction and a retracting direction, the method including adjusting the amount of displacement of the movable loading unit based on one or both of the number of loaded sheets and the cumulative number of sheets.

According to this aspect, the same effect as those of one or both of the sixth aspect and the seventh aspect can be obtained.

Figure 8:
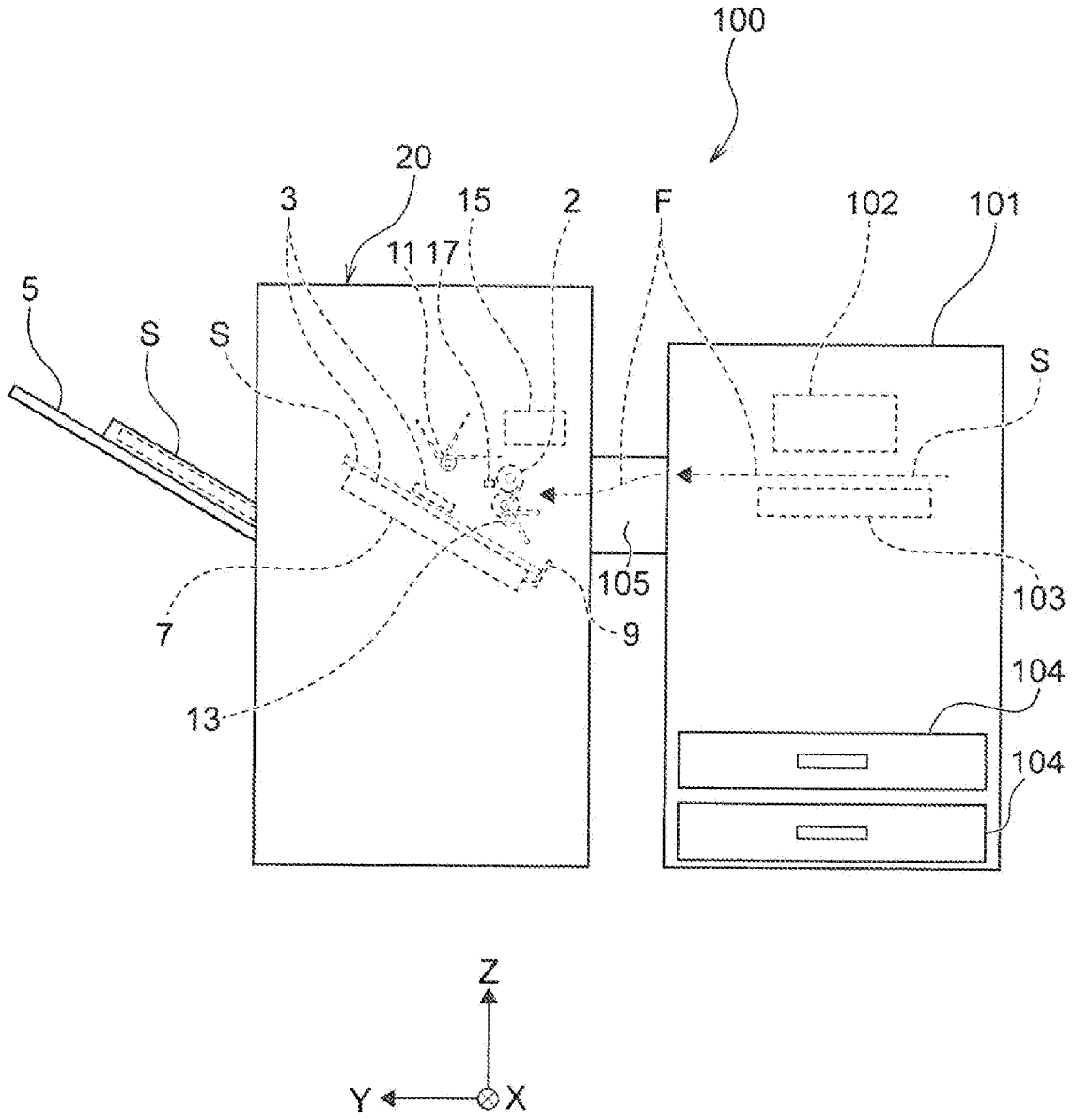
FIG. 8 is an external front view of a printing system according to Embodiment 1.

The overall configuration of a printing system 100 including a sheet transport device 1 according to the embodiment will be described with reference to FIG. 8.

The printing system 100 includes a printing device 101 and a post-processing device 20 to which a sheet S subjected to printing by the printing device 101 is conveyed through a communication unit 105. The post-processing device 20 includes a sheet transport device 1. In FIG. 8, a reference numeral 102 indicates a printing head that performs printing on the sheet S, a reference numeral 103 indicates a platen that supports a lower surface of the sheet S to be printed, and a reference numeral 104 indicates a sheet stacker that feedably accommodates the sheet S for printing.

The post-processing device 20 includes a post-processing unit 3 that performs post-processing which will be described later, and a discharged sheet receiving unit 5 to which the sheet S that has passed through the post-processing unit 3 is discharged by a discharge unit (not illustrated). The discharged sheet receiving unit 5 receives the sheet S discharged through the post-processing unit 3 of the post-processing device 1, and is configured to receive any sheet S regardless of whether post-processing is performed in the post-processing unit 3.

As illustrated in FIG. 1, the post-processing device 20 includes a loading unit 7 in which the sheet S to be conveyed is loaded, a first transport unit 11 that imparts a transport force P1 to the sheet S loaded into the loading unit 7 toward an alignment unit 9, a second transport unit 13 that is located between the first transport unit 11 and the alignment unit 9 and imparts a transport force P2 to the sheet S toward the alignment unit 9, a post-processing unit 3 that performs post-processing on the sheet S transported to the alignment unit 9, and a control unit 15 that controls a rotation operation of the first transport unit 11 and the second transport unit 13 and a post-processing operation of the post-processing unit 3. The sheet S conveyed from the printing device 101 is transported in a transport direction F (a +Y direction) via a transport roller pair 2 and is placed on the loading unit 7.

The post-processing unit 3 can execute a plurality of types of post-processing described below. In FIG. 1, a reference numeral 12 indicates a transport trajectory of a rear end of the sheet S.

The first transport unit 11 imparts the transport force P1 to each of the sheets S loaded into the loading unit 7 toward the alignment unit 9, that is, in a direction opposite to the transport direction F (a −Y direction). The first transport unit 11 includes a shaft 4 and a first paddle 6 that is mounted on the shaft 4 and rotates together with the shaft 4. The first paddle 6 is made of a rubber material.

As the first paddle 6 is rotated, the first transport unit 11 imparts the transport force P1 to the sheet S toward the alignment unit 9, that is, in the −Y direction, and the rear end of each of the sheets S comes into contact and is aligned with the alignment unit 9.

The second transport unit 13 is located between the first transport unit 11 and the alignment unit 9, and imparts the transport force P2 to each of the sheets S loaded into the loading unit 7 toward the alignment unit 9. The second transport unit 13 includes a shaft 8 and a second paddle 10 that is mounted on the shaft 8 and rotates together with the shaft 8. The second paddle 10 is also made of a rubber material.

As the second paddle 10 is rotated, the second transport unit 13 cooperates with the first transport unit 11 and imparts the transport force P2 to the sheet S toward the alignment unit 9, and the rear end of each of the sheets S comes into contact and is aligned with the alignment unit 9.

The sheet transport device 1 according to the embodiment includes the loading unit 7, the second transport unit 13 as a transport unit 22 that imparts to the sheet S loaded on the sheet loading surface 21 of the loading unit 7 the transport force P2 for transporting the sheet S toward the alignment unit 9, and an adjustment unit 23 that adjusts the transport force P2.

The adjustment unit 23 includes a movable loading unit 24 formed so that at least part of the sheet loading surface 21 can protrude toward the transport unit 22, and a driving unit 25 that displaces the movable loading unit 24 in a protruding direction and a retracting direction. The "protruding direction" of the movable loading unit 24 is a direction approaching the facing transport unit 22, and the "retracting direction" thereof is a direction away from the transport unit 22.

Movable Loading Unit

Figure 2:
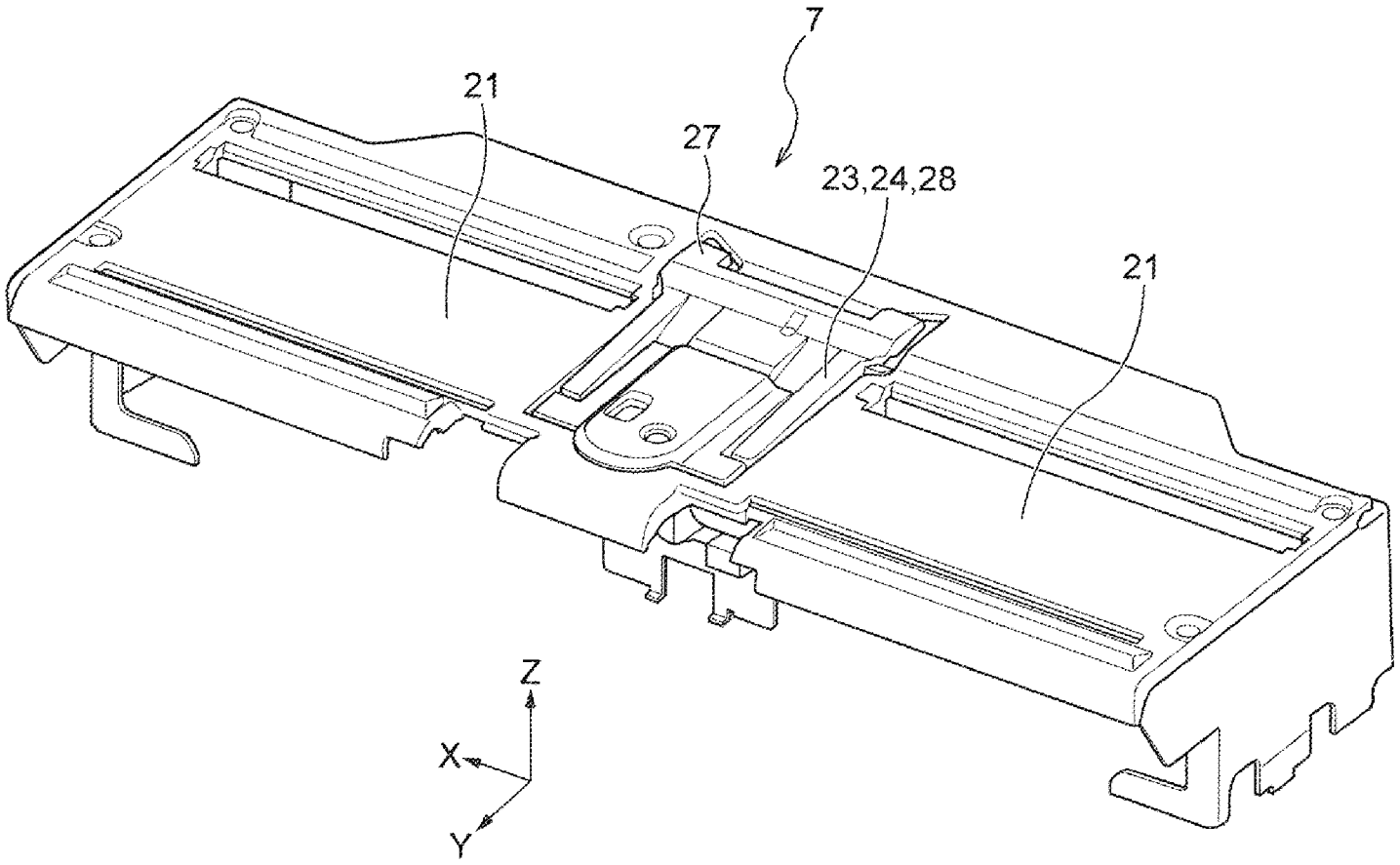
FIG. 2 is a perspective view of a loading unit including a movable loading unit according to Embodiment 1.

In the embodiment, as illustrated in FIG. 2, the movable loading unit 24 that is a constituent of the adjustment unit 23 is part of the sheet loading surface 21 in the width direction (the X-axis direction) that intersects the direction of the transport force P2 and is a unit that faces the transport unit 22. That is, in the embodiment, the movable loading unit 24 is not the entire sheet loading surface 21 but part of the center of the sheet loading surface 21 in the width direction (the X-axis direction).

The entire sheet loading surface 21 in the width direction may be configured as the movable loading unit 24. Alternatively, a plurality of movable loading units 24 may be provided in the width direction.

In FIG. 2, the transport unit 22 located at a position facing the movable loading unit 24 has been omitted.

Figure 3:
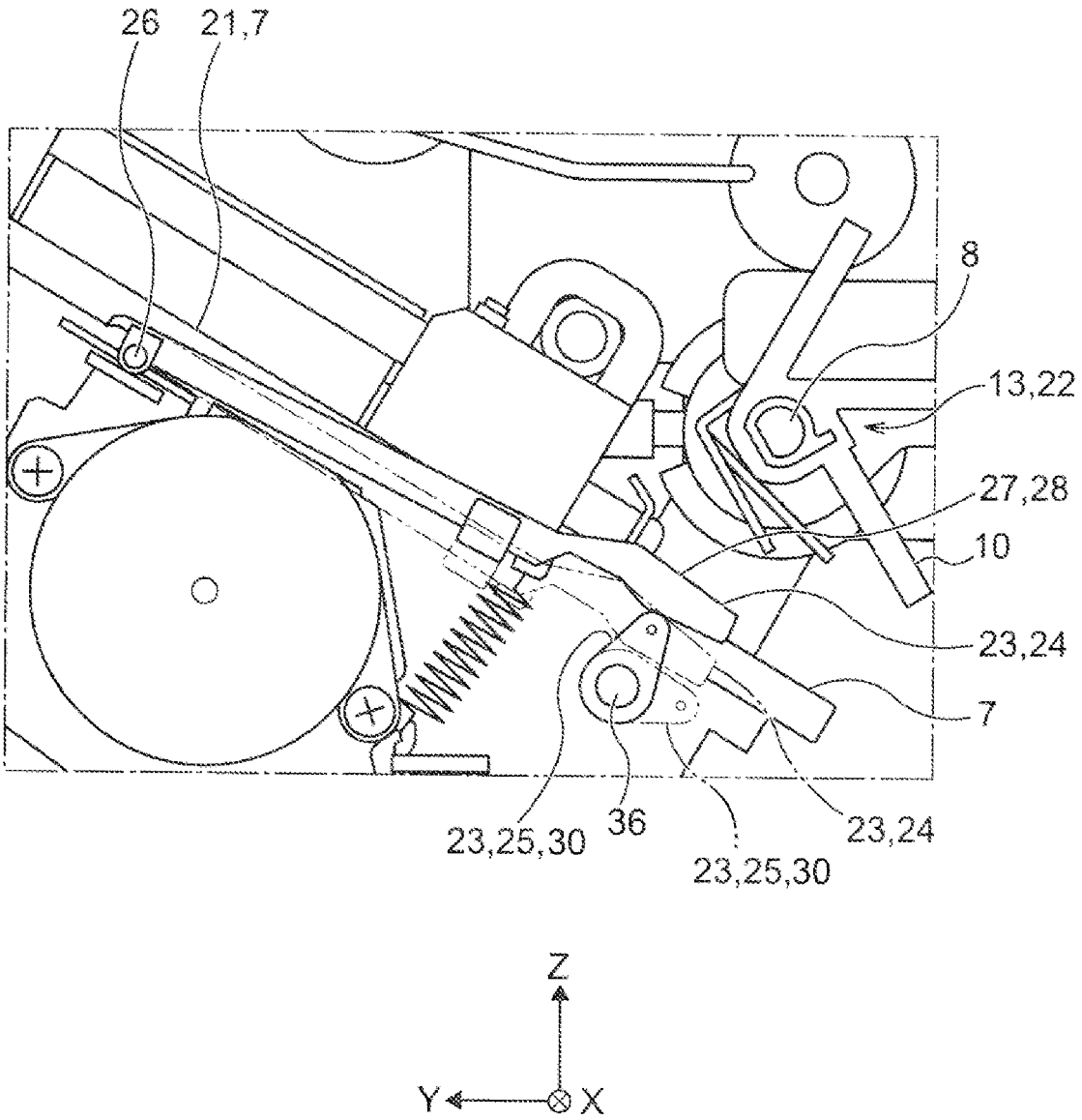
FIG. 3 is an enlarged side view of the movable loading unit according to Embodiment 1.

In the embodiment, as illustrated in FIG. 3, the movable loading unit 24 is constituted by a swinging portion 28 pivotally supported by a fulcrum shaft 26 in a direction intersecting a direction of the transport force P2 and including a free end 27 that swings.

Driving Unit

As illustrated in FIG. 3, the driving unit 25 includes a cam 30 in the embodiment. The driving unit 25 is configured to displace the swinging portion 28 in the "protruding direction" and "retracting direction" by rotating the cam 30 around a fulcrum 36 with power.

In FIG. 3, the cam 30 illustrated by a solid line is in a state in which the swinging portion 28 is displaced in the "protruding direction." The cam 30 illustrated by a two-dot chain line is in a state in which the swinging portion 28 is displaced in the "retracting direction". The movable loading unit 24 is configured to be located below the sheet loading surface 21 in a retracted position.

Figure 4:
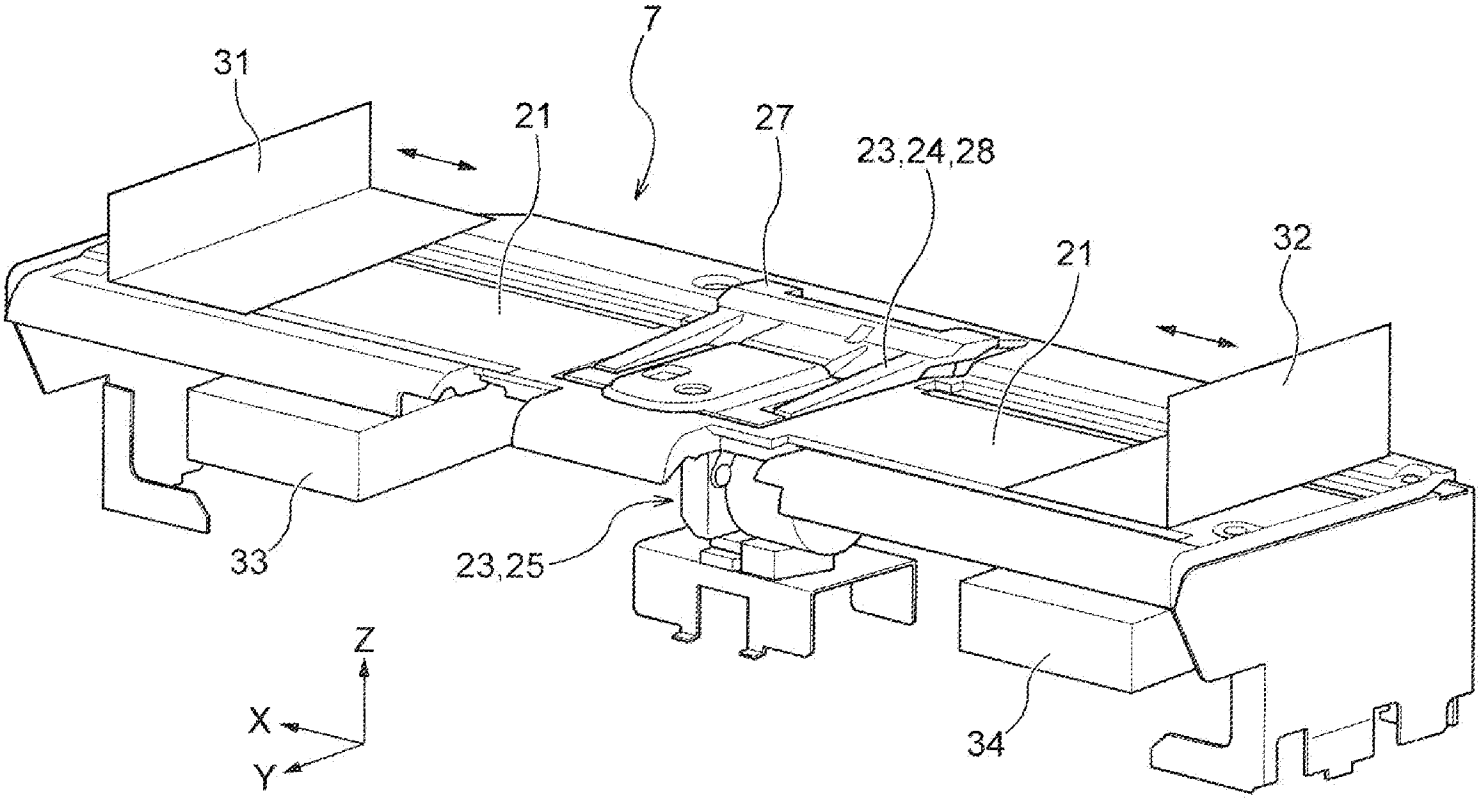
FIG. 4 is a perspective view of a loading unit including a movable loading unit and side cursors according to Embodiment 1.

As illustrated in FIG. 4, the driving unit 25 is disposed on the back surface side of the loading unit 7. The cam 30 is in a hidden position in FIG. 4.

In the embodiment, the loading unit 7 includes a pair of side cursors 31 and 32 for aligning both end portions in the width direction (the X-axis direction) of the sheet S loaded on the sheet loading surface 21. The pair of side cursors 31 and 32 is moved in the width direction by a pair of side cursor moving units 33 and 34. As illustrated in FIG. 4, the pair of side cursor moving units 33 and 34 is disposed on the back surface side of the loading unit 7.

The pair of side cursors 31 and 32 can widen or narrow a distance between edge guides of one side cursor 31 and the other side cursor 32, and align the width direction of the sheet S by being brought into contact with both side ends of the sheet S loaded into the loading unit 7. The rear end and the side end of the sheet S are aligned by bringing the alignment unit 9 and the pair of side cursors 31 and 32 into contact with the sheet S. As a result, the sheet S is aligned. This pair of side cursors 31 and 32 is also used for shift processing.

Furthermore, the driving unit 25 is disposed in a space between the pair of side cursor moving units 33 and 34.

In addition, in the embodiment, the sheet loading device 1 includes the control unit 15 that controls the adjustment unit 23, and a loading number counting unit 37 (refer to FIG. 1) that counts the number of sheets S loaded into the loading unit 7. Furthermore, the control unit 15 is configured to perform displacement by the driving unit 25 based on the number of loaded sheets counted by the loading number counting unit 37. In the embodiment, the loading number counting unit 37 is constituted by an optical sensor.

The transport force P2 to the sheet S of the transport unit 22 changes between an initial state of start of sheet transportation and a state in which the number of loaded sheets has increased. As the number of loaded sheets S increases, a distance to the driving unit 25 decreases, and thus the transport force P2 gradually increases.

The control unit 15 is configured to perform displacement by the driving unit based on the number of loaded sheets counted by the loading number counting unit 37. That is, the movable loading unit 24 is displaced in the "retracting direction" as the number of loaded sheet S increases. That is, the displacement is performed in a direction that curbs an increase in the transport force P2. For this displacement, retraction may be gradual as the number of loaded sheets S increases, or may be stepwise.

Displacement of Driving Unit Due to Number of Loaded Sheets

Figure 5:
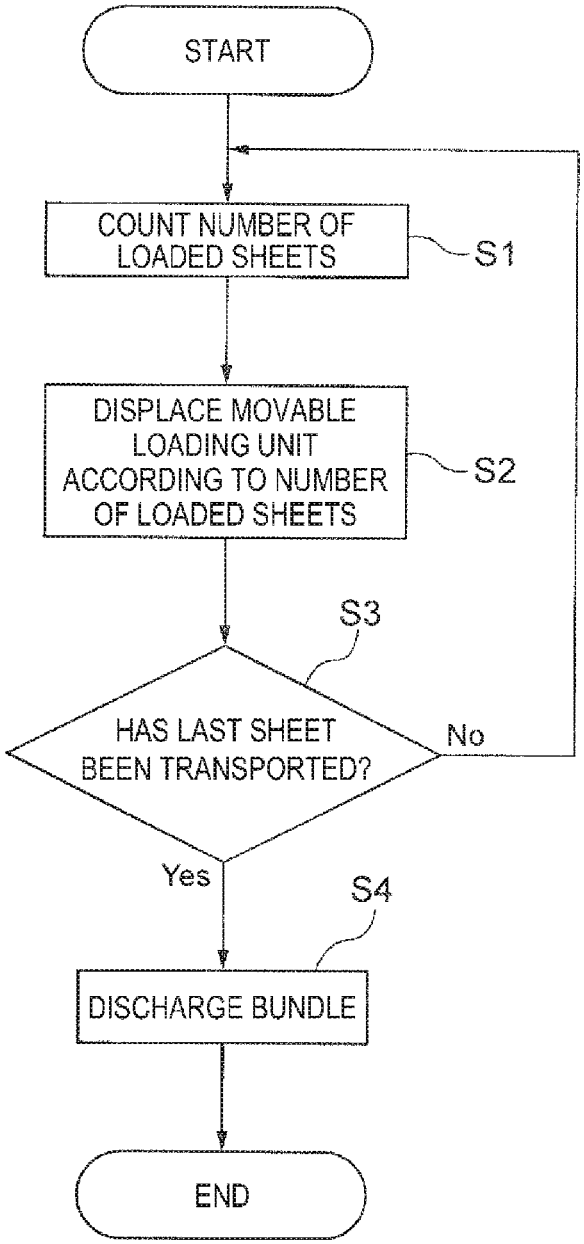
FIG. 5 is an example of a flowchart used for controlling a driving unit of Embodiment 1.

An example of a flow of displacement control of the driving unit 25 by the control unit 15 based on the number of loaded sheets is described with reference to FIG. 5. In Step S1, the number of loaded sheets counted by the loading number counting unit 37 is acquired. Subsequently, in Step S2, the movable loading unit 24 is displaced by the driving unit 25 according to the acquired number of loaded sheets.

For this displacement, the movable loading unit 24 is displaced by the driving unit 25 using setting B of a table shown in FIG. 7. The setting B is an example for the sake of description, and is a case in which a bundle of 50 sheets is created. An amount of displacement of the movable loading unit 24 is shown to be reduced stepwise to 2.0 mm, 1.5 mm, 1.0 mm, 0.5 mm, and 0.0 mm for every 10 sheets. Of course, the present disclosure is not limited to this example. Here, the amount of displacement is a distance between the sheet loading surface 21 and an upper surface of the movable loading unit 24 after displacement.

Subsequently, in Step S3, whether the fiftieth last sheet S has been transported is determined. When the determination is YES, the process proceeds to Step S4 and ends. When the determination is NO, the process returns to Step S1.

In addition, in the embodiment, the sheet loading device 1 includes a counting unit 17 (refer to FIG. 1) that counts the cumulative number of sheets S transported by the transport unit 22. In the embodiment, the counting unit 17 is constituted by an optical sensor, but in the control unit 15, a configuration in which counting is performed in a software manner using sensing by another sensor that detects passage of the sheet S from the first sheet S of the start of use may be adopted. In the embodiment, the counting unit 17 and the loading number counting unit 37 are separately provided, but the functions of both counting units 17 and 37 may be performed by a single counting unit.

The wear of the second paddle 10 of the transport unit 22 progresses with continued use, and the transport force P2 gradually decreases. The cumulative number of the sheet S counted by the counting unit 17 is information corresponding to the degree of wear of the transport unit 22 due to continued use.

The control unit 15 is configured to perform displacement by the driving unit 25 based on the cumulative number. That is, the displacement of the driving unit 25 is performed so as to compensate for a decrease in the transport force P2 due to the wear.

Displacement of Driving Unit Due to Cumulative Number

Figure 6:
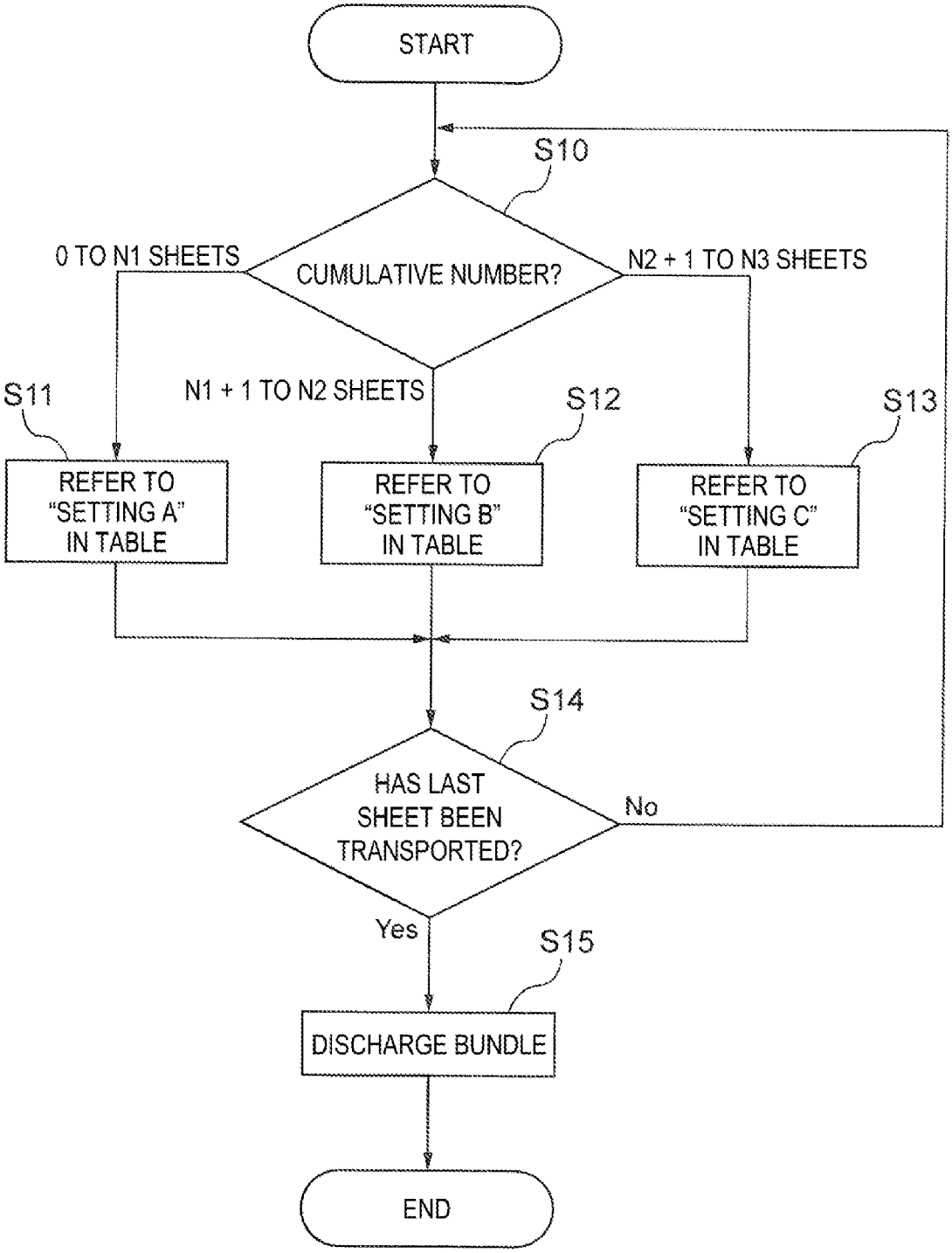
FIG. 6 is an example of a flowchart used for controlling the driving unit of Embodiment 1.

An example of a flow of displacement control of the driving unit 25 by the control unit 15 based on the cumulative number is described with reference to FIG. 6. In Step S10, the cumulative number of sheets S counted by the counting unit 17 is determined. When the cumulative number of sheets is N1 or less in Step S10, the process proceeds to Step S11. In Step S11, the displacement of the movable loading unit 24 is performed by the driving unit 25 using setting A of the table shown in FIG. 7. The setting A is an example for the sake of description, and is a case in which a bundle of 50 sheets is created. Specifically, the setting A is 0.0 mm for all 50 sheets and thus the movable loading unit 24 is held in a state of being located below the sheet loading surface without displacement. This is because, when the cumulative number of sheets is N1 or less, the decrease in the transport force P2 due to the wear of the transport unit 22 is small.

When the cumulative number of sheets exceeds N1 and is equal to or less than N2 in Step S10, the process proceeds to Step S12. In Step S12, the setting B of the table shown in FIG. 7 is used. The setting B is an example for the sake of description, and is a case in which a bundle of 50 sheets is created. Specifically, as described above, the setting B is a displacement in which the amount of displacement of the movable loading unit 24 is reduced stepwise to 2.0 mm, 1.5 mm, 1.0 mm, 0.5 mm, and 0.0 mm for every 10 sheets. This is based on the idea that, when the cumulative number of sheets exceeds N1 and is equal to or less than N2, the decrease in the transport force P2 due to the wear of the transport unit 22 cannot be ignored.

When the cumulative number of sheets exceeds N2 and is equal to or less than N3 in Step S10, the process proceeds to Step S13. In Step S13, setting C of the table shown in FIG. 7 is used. The setting C is an example for the sake of description, and is a case in which a bundle of 50 sheets is created. Specifically, the setting C is a displacement in which the amount of displacement of the movable loading unit 24 is reduced stepwise to 4.0 mm, 3.5 mm, 3.0 mm, 2.5 mm, 2.0 mm for every 10 sheets. This is based on the idea that, when the cumulative number of sheets exceeds N2 and is equal to or less than N3, the decrease in the transport force P2 due to the wear of the transport unit 22 is further increased and further cannot be ignored. Here, N1, N2, and N3 are set in a pre-endurance test.

In addition, in the embodiment, the control unit 15 is configured to perform displacement by the driving unit 25 based on at least one or both of the number of loaded sheets and the cumulative number of sheets and at least one or more additional elements of the following (1) to (4):

(1) A basis weight of the sheet is greater than a predetermined amount (2) A size of the sheet is greater than a predetermined size (3) Humidity is higher than a predetermined value, or temperature is lower than a predetermined value (4) When the sheet is subjected to printing, a print density is higher than a predetermined value.

Here, the "basis weight" is a weight (g) of a sheet of 1 m×1 m. The "print density" is an amount of discharge of ink discharged per unit area, and is also referred to as duty.

(1) The sheet S is heavy when the basis weight of the sheet S is greater than the predetermined amount, and thus it is difficult to transport the sheet S. Therefore, the movable loading unit 24 is brought closer to the transport unit 22 to increase the transport force P2. The "predetermined amount" is set so that an appropriate transport force can be obtained by collecting data in advance regarding the relationship between the basis weight, the amount of displacement of the movable loading unit 24, and the transport force P2. The "predetermined amount" may be set in multiple stages.

(2) When a size of the sheet S is greater than a predetermined size, a contact area between the sheets S is large, and thus it is difficult to transport the sheet S. Therefore, the movable loading unit 24 is brought closer to the transport unit 22 to increase the transport force P2. The "predetermined size" is set so that an appropriate transport force can be obtained by collecting data in advance regarding the relationship between the size of the sheet S, the amount of displacement of the movable loading unit 24, and the transport force P2.

(3) When the humidity is higher than a predetermined value, friction between the sheets S increases, and thus it is difficult to transport the sheet S. Therefore, the movable loading unit 24 is brought closer to the transport unit 22 to increase the transport force P2. The "predetermined value" is set so that an appropriate transport force can be obtained by collecting data in advance regarding the relationship between the humidity, the amount of displacement of the movable loading unit 24, and the transport force P2.

Further, since a material of the transport unit 22 is typically rubber, when the temperature is lower than a predetermined value, the material hardens, the transport force P2 is reduced, and thus it is difficult to transport the sheet S. Therefore, the movable loading unit 24 is brought closer to the transport unit 22 to increase the transport force P2. The "predetermined value" is set so that an appropriate transport force can be obtained by collecting data in advance regarding the relationship between the temperature, the amount of displacement of the movable loading unit 24, and the transport force P2.

(4) In a case in which the sheets S are subjected to printing, when the print density is higher than a predetermined value, the friction between the sheets S is large, and thus it is difficult to transport the sheet S. Therefore, the movable loading unit 24 is brought closer to the transport unit 22 to increase the transport force P2. The "predetermined value" is set so that an appropriate transport force can be obtained by collecting data in advance regarding the relationship between the print density, the amount of displacement of the movable loading unit 24, and the transport force P2.

When at least one of the above (1) to (4) is applicable, the table used by the control unit 15 is a table that is similar to the table in FIG. 7.

Specifically, numerical values of the respective distances in the setting A, the setting B, and the setting C in the table of FIG. 7 are created by considering the above (1) to (4).

Post-Processing

In the embodiment, the post-processing unit 3 performs post-processing on the sheet S transported to the alignment unit 9. The post-processing performed by the post-processing unit 3 is stacking process, shift processing, or stapling processing in the embodiment. The type of the post-processing unit 3 is not limited to the three described above.

Here, the "stacking processing" means a process of aligning the transported sheets S in the alignment unit 9 and sequentially stacking them in the loading unit 7 as they are. In addition, the "shift processing" means a process of shifting a bundle of a predetermined number of aligned sheets S in the width direction (the X-axis direction) so that each bundle is located shifted. In addition, the "stapling processing" means a process of stapling a bundle of a predetermined number of aligned sheets S with staples, and is a process in which the alignment standard is stricter than in the stacking processing and the shift processing.

The post-processing transports the sheet S loaded into the loading unit 7 by the first paddle 6 and the second paddle 10, and brings the sheet S into contact with the alignment unit 9. Thus, the side of the sheet S in contact with the alignment unit 9 is matched to, or aligned with the other sheet S. The alignment of the sheet S in the width direction (X-axis direction) is performed by moving the pair of side cursors 31 and 32 and bringing them into contact with both sides of the sheet S.

In the shift processing, the bundle of aligned sheets S is shifted in the width direction by the pair of side cursors 31 and 32 so that each bundle is located shifted. In the stapling processing, the bundle of aligned sheets S is bound by a stapling device.

The alignment standard is a standard for at least an amount of shift in a transport direction of the sheet relative to a reference sheet alignment position. A state in which the amount of shift is small corresponds to a state in which the alignment standard is strict. The alignment standard may include the amount of shift in the width direction of the sheet. When the amount of shift is equal to or less than a predetermined amount, it is a standard that satisfies the quality of the post-processing.

In the embodiment, the sheet S loaded into the loading unit 7 and aligned in the alignment unit 9 can be set to any one of the stacked state, the shift loading state, and the pre-stapling layered state.

Here, the "stacked state" means a state in which the sheet S is subjected to the stacking processing. The "shift loading state" means a state in which the sheet S is subjected to the shift processing. The "pre-stapling layered state" means a state before the sheet S is subjected to the stapling. In the post-processing, the alignment standard is not strict for the stacking processing and the shift processing, but the alignment standard is strict for the stapling processing.

Therefore, the control unit 15 is configured so as not to cause the adjustment unit 23 to operate when the stacked state or the shift loading state is set, and cause the adjustment unit 23 to operate when the pre-stapling layered state is set.

DESCRIPTION OF EFFECTS OF EMBODIMENT (1) According to the embodiment, the adjustment unit 23 for adjusting the transport force P2 is provided. Furthermore, the adjustment unit 23 includes the movable loading unit 24 formed so that part of the sheet loading surface 21 protrudes toward the transport unit 22, and the driving unit 25 that displaces the movable loading unit 24. Thus, the adjustment unit 23 adjusts the amount of displacement of the movable loading unit 24 so that the transport force P2 does not decrease, and the occurrence of a sheet transportation failure is curbed.

(2) In addition, according to the embodiment, the movable loading unit 24 is part of the sheet loading surface 21 and is a unit that faces the transport unit 22. Thus, the transport force P2 is adjusted at a position at which the transport force P2 acts, and thus it is effective.

(3) In addition, according to the embodiment, the movable loading unit 24 has a swinging portion 28 of which one end is supported by the fulcrum shaft 26 and the free end 27 swings, and the driving unit 25 that displaces the swinging portion 28 is the cam 30. Thus, the protrusion or the retraction of the movable loading unit 24 can be performed by a small number of components.

(4) In addition, according to the embodiment, the driving unit 25 is disposed on the back surface side of the loading unit 7, and thus the sheet transport device 1 can be configured without increasing a size of the surface side of the loading unit 7. (5) In addition, according to the embodiment, the pair of side cursor moving units 33 and 34 is disposed on the back surface side of the loading unit 7, and the driving unit 25 is disposed between the pair of side cursor moving units 33 and 34. Thus, since the driving unit 25 is disposed in an empty space on the back side of the loading unit 7, the sheet transport device 1 can be configured without increasing a size of the back surface side of the loading unit 7.

(6) In addition, the transport force P2 to the sheet S of the transport unit 22 changes between the initial state of start of transportation of the sheet S and the state in which the number of loaded sheets S has increased.

According to the embodiment, the control unit 15 performs the displacement by the driving unit 25 based on the number of loaded sheets counted by the loading number counting unit 37 and thus can correspond to the change. That is, since the transport force P2 can be reduced according to an increase in the number of loaded sheets, the transport force P2 to the sheet S can be substantially constant.

(7) In addition, since the transport unit 22 wears out with continued use, the transport force of the transport unit 22 itself gradually decreases. The cumulative number of the sheet S counted by the counting unit 17 is information corresponding to the degree of wear due to the continued use.

According to the embodiment, the control unit 15 performs the displacement by the driving unit 25 based on the cumulative number of sheets, thus, a decrease in the transport force of the transport unit 22 itself due to the wear can be covered by the performing of the displacement of the movable loading unit 24, and the transport force P2 can be kept substantially constant.

(8) In addition, according to the embodiment, when at least one of the following (1) to (4) is applicable, it is possible to bring the movable loading unit 24 closer to the transport unit 22 to increase the transport force P2, and thus it is possible to curb the occurrence of the sheet transportation defect:

(1) The basis weight of the sheet is greater than a predetermined amount
(2) The size of the sheet is greater than a predetermined size
(3) Humidity is higher than a predetermined value, or temperature is lower than a predetermined value
(4) When the sheet is subjected to printing, a print density is higher than a predetermined value.

(9) In addition, in the embodiment, the sheet S loaded into the loading unit 7 and aligned in the alignment unit 9 can be set to any one of the stacked state, the shift loading state, and the pre-stapling layered state. The alignment standard is not strict for the stacked state and the shift loading state. On the other hand, the alignment standard is strict for the pre-stapling layered state.

According to the embodiment, in the case of the stacked state or the shift loading state in which the degree of requirement of alignment quality is low, that is, the alignment standard is not strict, the wearing of the transport unit 22 can be reduced by giving priority to curbing wear over ensuring the transport force P2, that is, by controlling the adjustment unit 23 so as not to cause the adjustment unit 23 to operate.

Other Embodiments

Although the sheet transport device and the method of controlling the sheet transport device according to the present disclosure are based on the sheet transport device having the configuration of the embodiment described above, as a matter of course, modifications, omission, and the like may be made to part of the configuration without departing from the gist of the disclosure of the present application.

In the embodiment described above, the type of post-processing has been described as the stacking processing, the shift processing, or the stapling processing, but is not limited thereto. Examples of other post-processing include punch processing. The punch processing can be controlled with similar positioning as in the stapling processing.

In addition, as a member for displacing the swinging portion 28, a rack and a pinion, a timing belt and a pulley, or the like may be used instead of the cam 30.

What is claimed is:

1. A sheet transport device comprising:

a loading unit at which a sheet to be conveyed is loaded;

a transport unit configured to impart to the sheet loaded at a sheet loading surface of the loading unit a transport force for transporting the sheet toward an alignment unit; and an adjustment unit configured to adjust the transport force, wherein the adjustment unit includes a movable loading unit formed so that at least part of the sheet loading surface is configured to protrude toward the transport unit and a driving unit configured to displace the movable loading unit in a protruding direction and a retracting direction.

2. The sheet transport device according to claim 1, wherein the movable loading unit is part of the sheet loading surface in a width direction intersecting a direction of the transport force and is a part facing the transport unit.

3. The sheet transport device according to claim 1, wherein the movable loading unit is a swinging portion pivotally supported in a direction intersecting a direction of the transport force and including a free end configured to swing and the driving unit includes a cam configured to displace the swinging portion.

4. The sheet transport device according to claim 1, wherein the driving unit is disposed on a back surface side of the loading unit.

5. The sheet transport device according to claim 4, wherein the loading unit includes a pair of side cursors configured to align both end portions in the width direction of the sheet loaded at the sheet loading surface, a pair of side cursor moving units configured to move positions of the pair of side cursors in the width direction is disposed on a back surface side of the loading unit, and the driving unit is disposed between the pair of side cursor moving units.

6. The sheet transport device according to claim 1, further comprising:

a control unit configured to control the adjustment unit; and a loading number counting unit configured to count the number of the sheet loaded at the loading unit, wherein the control unit performs displacement by the driving unit based on the number of the loaded sheet counted by the loading number counting unit.

7. The sheet transport device according to claim 6, wherein the control unit performs the displacement by the driving unit based on the number of the loaded sheet and at least one or more additional elements of the following (1) to (4):

(1) a basis weight of the sheet is greater than a predetermined amount (2) a size of the sheet is greater than a predetermined size (3) humidity is higher than a predetermined value, or temperature is lower than a predetermined value (4) when the sheet is subjected to printing, a print density is higher than a predetermined value.

8. The sheet transport device according to claim 1, further comprising:

a control unit configured to control the adjustment unit; and a counting unit configured to count the cumulative number of the sheet transported by the transport unit, wherein the control unit performs displacement by the driving unit based on the cumulative number of the sheet.

9. The sheet transport device according to claim 8, wherein the control unit performs the displacement by the driving unit based on the cumulative number of the sheet and at least one or more additional elements of the following (1) to (4):

(1) a basis weight of the sheet is greater than a predetermined amount (2) a size of the sheet is greater than a predetermined size (3) humidity is higher than a predetermined value, or temperature is lower than a predetermined value (4) when the sheet is subjected to printing, a print density is higher than a predetermined value.

10. The sheet transport device according to claim 1, further comprising:

a control unit configured to control the adjustment unit;

a loading number counting unit configured to count the number of the sheet loaded at the loading unit; and a counting unit configured to count the cumulative number of the sheet transported by the transport unit, wherein the control unit performs the displacement by the driving unit based on the number of the loaded sheet, the cumulative number of the sheet, and at least one or more additional elements of the following (1) to (4):

(1) a basis weight of the sheet is greater than a predetermined amount (2) a size of the sheet is greater than a predetermined size (3) humidity is higher than a predetermined value, or temperature is lower than a predetermined value (4) when the sheet is subjected to printing, a print density is higher than a predetermined value.

11. The sheet transport device according to claim 1, wherein the sheet loaded at the loading unit and aligned by the alignment unit is configured to be in any of a stacked state, a shift loading state, and a pre-stapling layered state and the control unit does not cause the adjustment unit to operate when the sheet is in the stacked state or the shift loading state and causes the adjustment unit to operate when the sheet is in the pre-stapling layered state.

12. A method of controlling a sheet transport device, the sheet transport device including:

a loading unit at which a sheet to be conveyed is loaded, a transport unit configured to impart to the sheet loaded at a sheet loading surface of the loading unit a transport force for transporting the sheet toward an alignment unit, an adjustment unit configured to adjust the transport force, and a loading number counting unit configured to count the number of the sheet loaded at the loading unit, the adjustment unit including:

a movable loading unit formed so that at least part of the sheet loading surface is configured to protrude toward the transport unit and a driving unit configured to displace the movable loading unit in a protruding direction and a retracting direction, the method comprising:

adjusting an amount of displacement of the movable loading unit based on the number of the loaded sheet.

13. The method of controlling a sheet transport device according to claim 12, wherein the sheet transport device further includes a counting unit configured to count the cumulative number of the sheet transported by the transport unit and the method further includes adjusting an amount of displacement of the movable loading unit based on the number of the loaded sheet and the cumulative number of the sheet.

14. A method of controlling a sheet transport device, the sheet transport device including:

a loading unit at which a sheet to be conveyed is loaded, a transport unit configured to impart to the sheet loaded at a sheet loading surface of the loading unit a transport force for transporting the sheet toward an alignment unit, an adjustment unit configured to adjust the transport force, and a counting unit configured to count the cumulative number of the sheet transported by the transport unit, the adjustment unit including:

a movable loading unit formed so that at least part of the sheet loading surface is configured to protrude toward the transport unit and a driving unit configured to displace the movable loading unit in a protruding direction and a retracting direction, the method comprising:

adjusting an amount of displacement of the movable loading unit based on the cumulative number of the sheet.

* * * * *